US009061802B2

(12) United States Patent
Viale et al.

(10) Patent No.: US 9,061,802 B2
(45) Date of Patent: Jun. 23, 2015

(54) POURER

(71) Applicant: Guala Closures S.p.A., Alessandria (IT)

(72) Inventors: Luca Viale, Alessandria (IT); Marco Giovannini, Milan (IT)

(73) Assignee: Guala Closures S.P.A., Alessandria (IT)

( * ) Notice: Subject to any disclaimer, the term of this patent is extended or adjusted under 35 U.S.C. 154(b) by 0 days.

(21) Appl. No.: 13/903,318

(22) Filed: May 28, 2013

(65) Prior Publication Data

US 2013/0320048 A1 Dec. 5, 2013

(30) Foreign Application Priority Data

May 29, 2012 (IT) ..... MI2012A0931

(51) Int. Cl.
*B67D 3/00* (2006.01)
*B65D 47/06* (2006.01)
*B65D 47/12* (2006.01)

(52) U.S. Cl.
CPC ..... *B65D 47/06* (2013.01); *B65D 47/123* (2013.01); *B65D 2101/0038* (2013.01)

(58) Field of Classification Search
CPC ..... B65D 2547/066; B65D 47/122; B65D 41/26; B65D 47/123; B65D 47/06; B65D 2101/0038
USPC ..... 222/482, 484–486, 566–568
See application file for complete search history.

(56) References Cited

U.S. PATENT DOCUMENTS

| | | | | |
|---|---|---|---|---|
| 6,422,415 | B1 * | 7/2002 | Manganiello | 220/714 |
| 6,422,423 | B1 * | 7/2002 | Rho | 222/111 |
| 6,488,058 | B1 * | 12/2002 | Dyer et al. | 141/346 |
| 7,959,034 | B2 * | 6/2011 | Faaborg et al. | 222/109 |
| 8,272,543 | B2 * | 9/2012 | Yang | 222/520 |
| 2006/0032872 | A1 * | 2/2006 | Yamane | 222/566 |
| 2006/0108382 | A1 | 5/2006 | Migliore | |
| 2007/0194047 | A1 * | 8/2007 | Tauber et al. | 222/109 |
| 2010/0320235 | A1 * | 12/2010 | Dubach | 222/212 |
| 2011/0309104 | A1 * | 12/2011 | Tauber et al. | 222/109 |
| 2013/0043277 | A1 * | 2/2013 | Lepage | 222/189.07 |

FOREIGN PATENT DOCUMENTS

| | | | | |
|---|---|---|---|---|
| DE | 1161776 B | | 1/1964 | |
| EP | 1535855 | * | 6/2005 | B65D 47/12 |
| GB | 922188 A | | 3/1963 | |

OTHER PUBLICATIONS

European Search Report dated Jan. 16, 2013, and cited references.

* cited by examiner

*Primary Examiner* — Paul R Durand
*Assistant Examiner* — Jeremy W Carroll
(74) *Attorney, Agent, or Firm* — Sorell, Lenna & Schmidt, LLP

(57) ABSTRACT

A pourer comprises a pouring body and members for liquid interception disposed inside the pouring body to form a first pouring orifice and a second pouring orifice, which define first and second pouring areas respectively, wherein the first pouring area is larger than the second pouring area. The members for liquid interception include a first wall and a second wall arranged in offset positions in the longitudinal direction and projecting into the pouring body from the inner surface of the pouring body.

8 Claims, 9 Drawing Sheets

POURER

TECHNICAL FIELD

The present invention concerns a pourer.

Particularly, the pourer of the present invention finds application in containers that are designed to contain liquids with various degrees of viscosity, such as oil or vinegar.

BACKGROUND OF THE INVENTION

A certain care is needed when pouring liquids such as oil and vinegar, because, with conventional pourers, the inclination of the container should be carefully controlled to pour the desired amount of liquid.

In an attempt to obviate such drawback, a number of pourers have been developed, that can provide different pouring rates depending on the liquid in the container and the amount of liquid to be poured.

Pourers as mentioned above are disclosed in FR 1489124, US 2006/0108382 and ES 1072865U.

These documents provide a pourer having two pouring orifices of different sizes, that a user can use by simply rotating the container to which the pourer is fitted, for the liquid to flow out of the selected pouring orifice.

Nevertheless, these pourers still have certain drawbacks.

In the pourer of FR 1489124, the conical bottom disposed in the top end is poorly effective in directing the flow of liquid from the container toward one of the two pouring orifices, especially when the pouring area of one of the two orifices should be considerably reduced.

The technical solution proposed by US 2006/0108382 also involves a high risk, especially when pouring from the pouring orifice with the smaller pouring area, that the liquid will also flow out of the other pouring orifice.

Finally, the diametral partition that is used in the pourer of ES 1072865U is inadequate in effectively directing the liquid toward one of the two pouring orifices.

From the background art as discussed above the need arises for a pourer that can prevent the flow of liquid directed toward an orifice from partially also leaking out of the other pouring orifice.

In view of the above prior art, the object of the present invention is to at least partially fulfill the above need, while at least partially obviating prior art drawbacks.

SUMMARY OF THE INVENTION

According to the present invention, this object is fulfilled by a pourer for a container having a neck and a mouth, said pourer comprising a pouring body extending in a longitudinal direction between a first end and a second end, said first end being located below said second end in said longitudinal direction, members for liquid interception arranged in said pouring body to define a first pouring orifice and a second pouring orifice, wherein said first and second pouring orifices define first and second pouring areas respectively, said first pouring area is larger than said second pouring area, wherein said members for liquid interception include a first wall and a second wall arranged in offset positions in said longitudinal direction and projecting into said pouring body from the inner surface of the pouring body, said first wall is located below said second wall in said longitudinal direction, and said second wall is designed to define said first pouring orifice and said second pouring orifice.

BRIEF DESCRIPTION OF THE DRAWINGS

The characteristics and advantages of the present invention will appear from the following detailed description of one practical embodiment, which is illustrated without limitation in the annexed drawings, in which.

Figure 1:
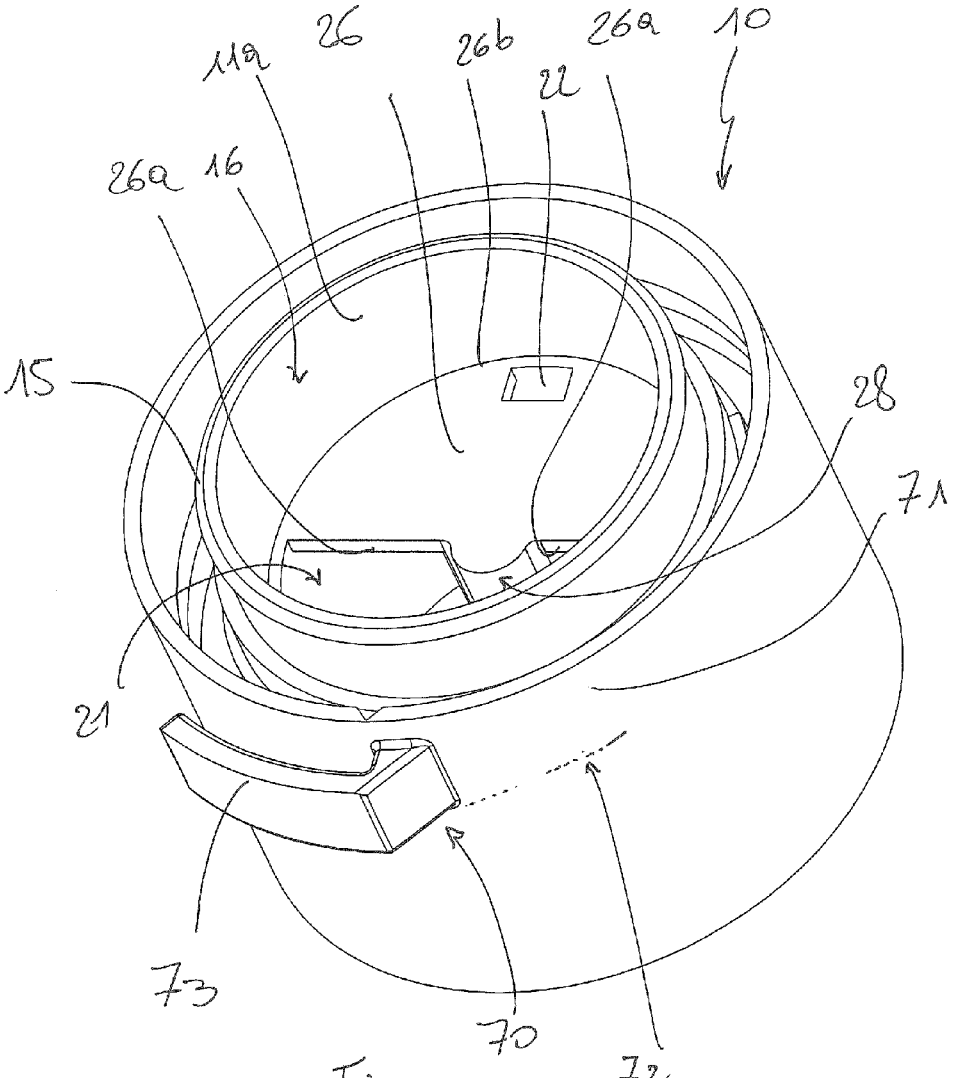
FIG. 1 shows a perspective view of a pourer according to an embodiment of the present invention.
Figure 2:
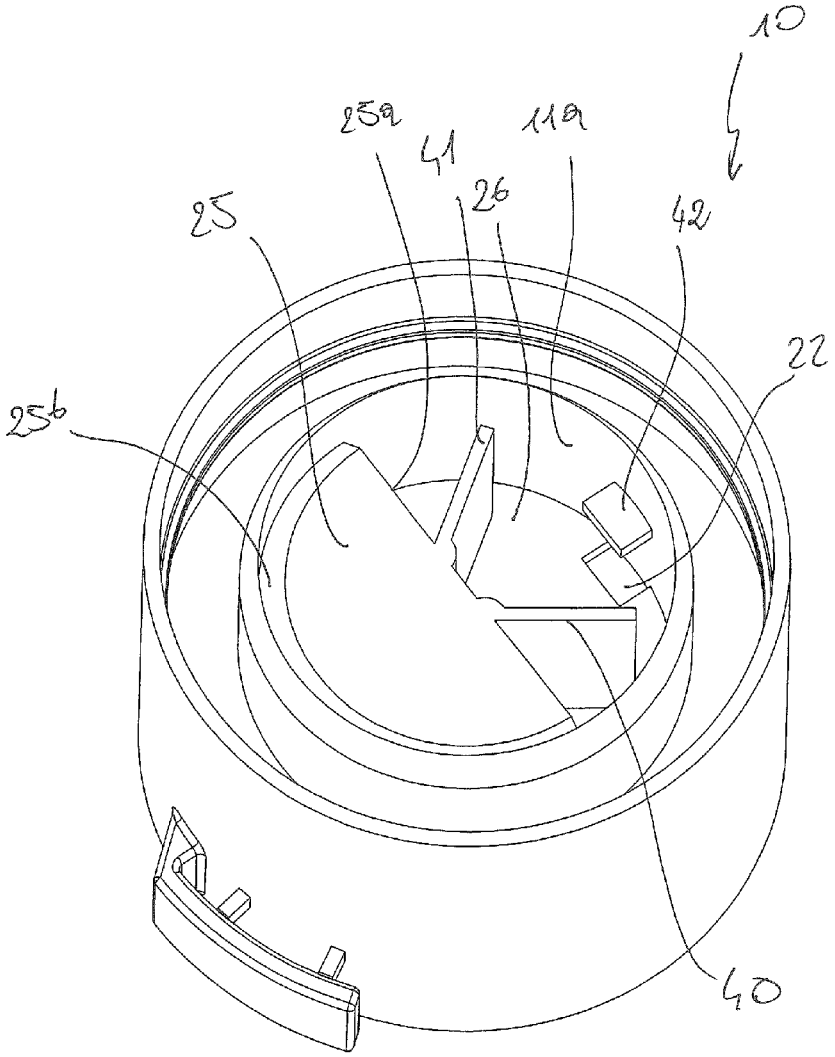
FIG. 2 is a different perspective view of the pourer of FIG. 1.
Figure 3:
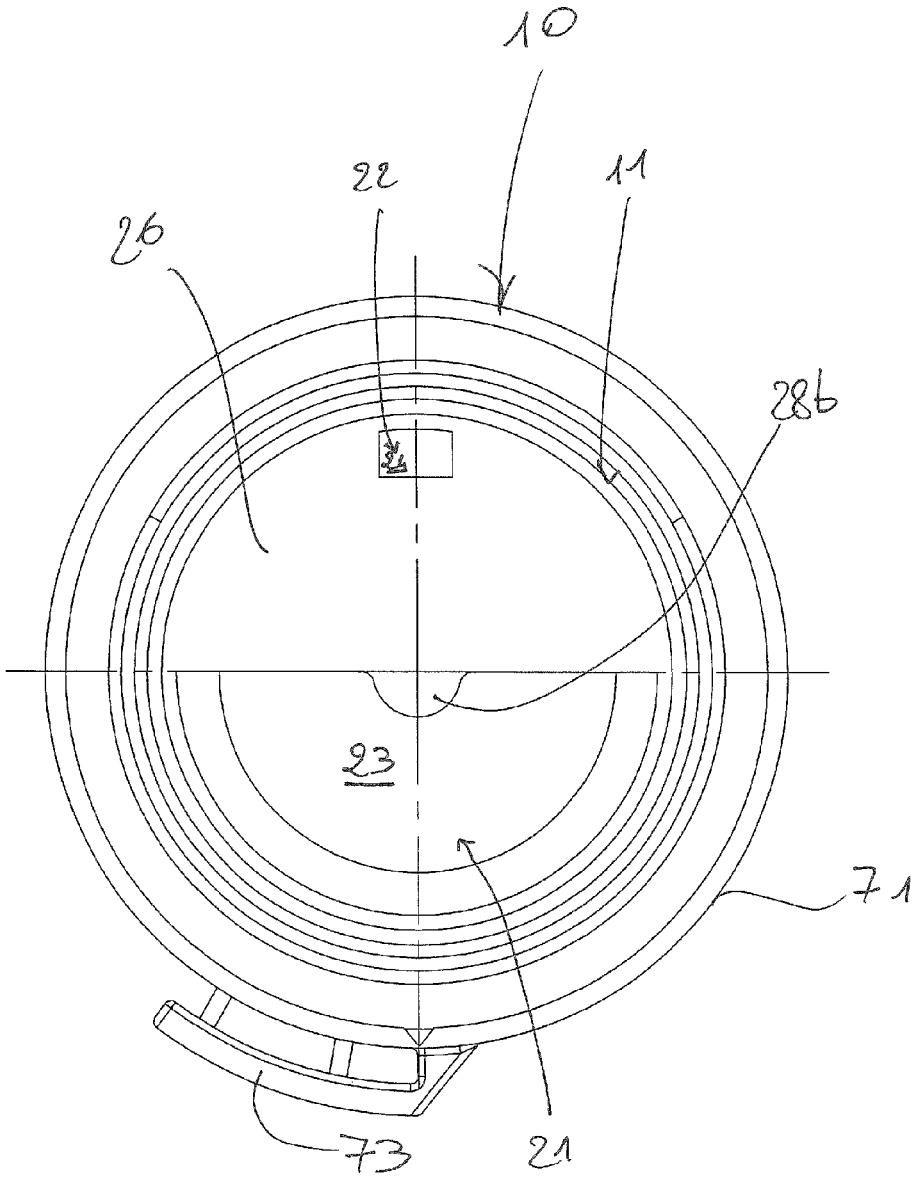
FIG. 3 shows a top view of the pourer of FIG. 1.
Figure 4:
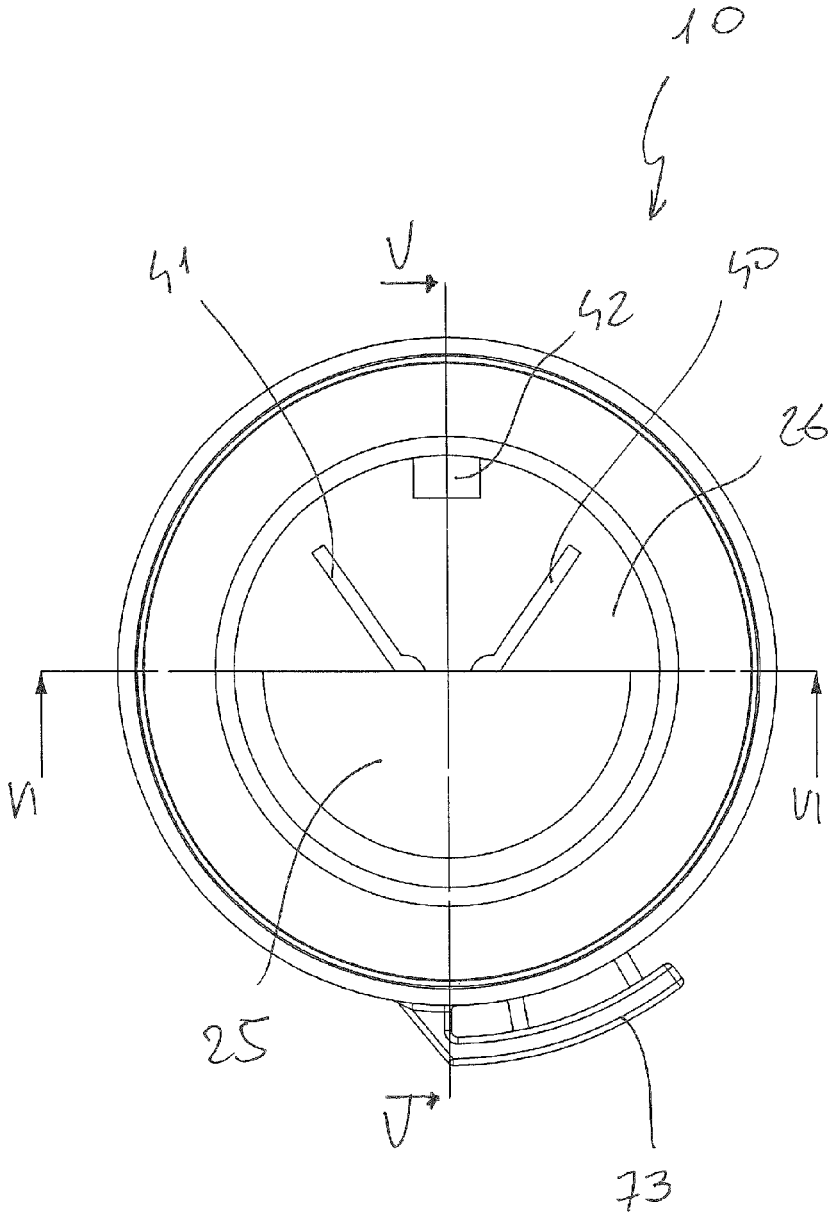
FIG. 4 shows a bottom view of the pourer of FIG. 1.
Figure 5:
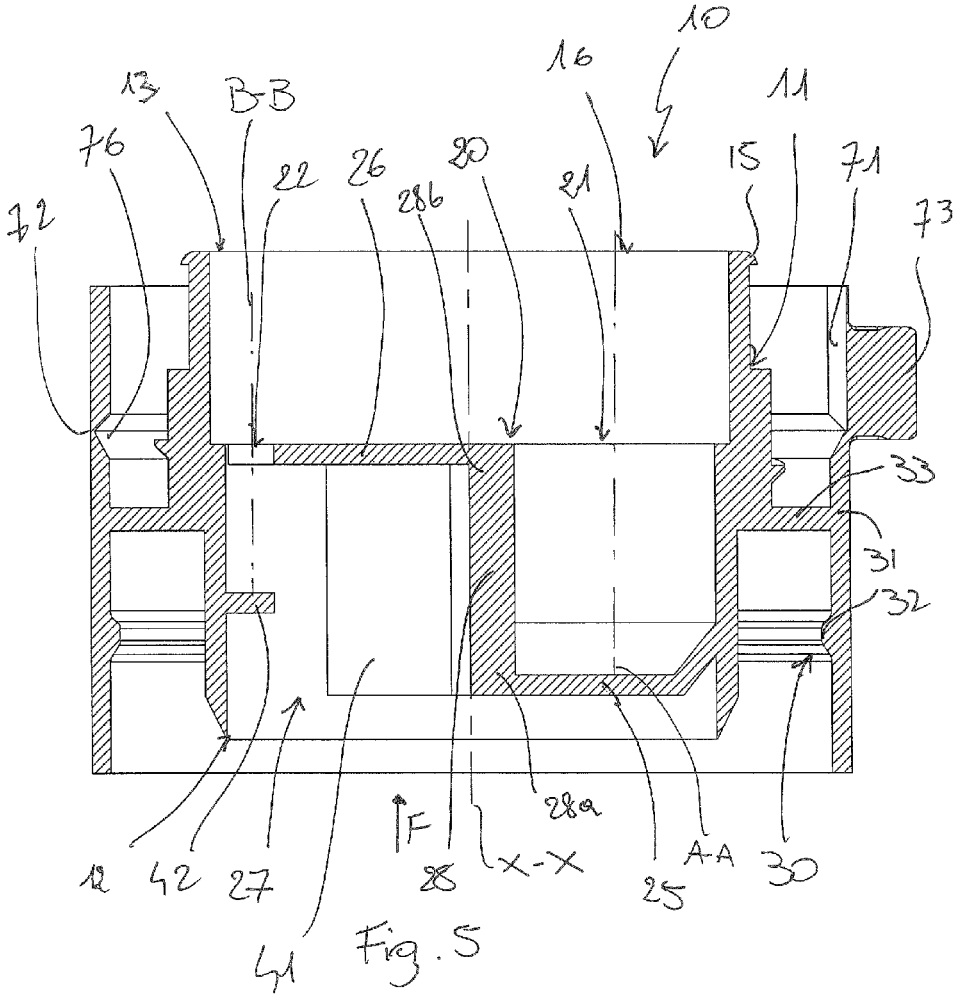
FIG. 5 is a sectional view taken along the line V-V of FIG. 4.
Figure 6:
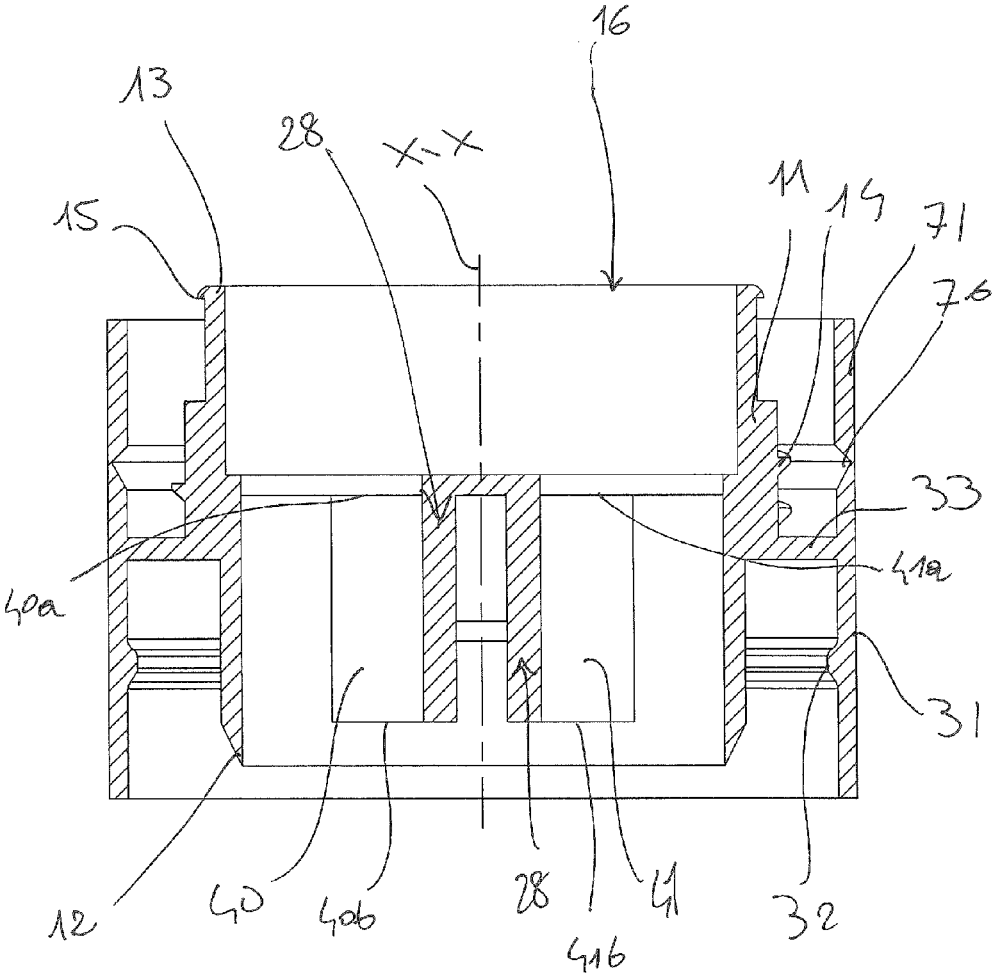
FIG. 6 is a sectional view taken along the line VI-VI of FIG. 4.
Figure 7:
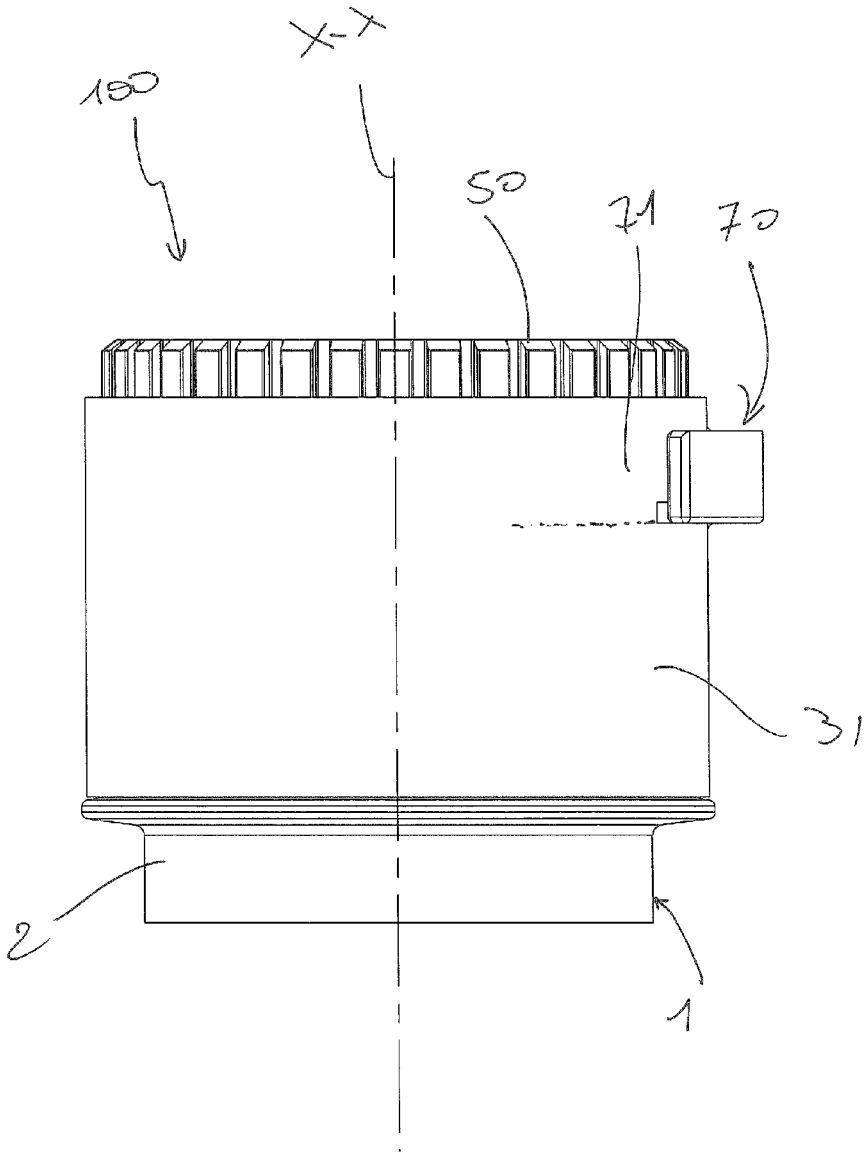
FIG. 7 is a side view of a closure with the pourer of FIG. 1, fitted to a container.
Figure 8:
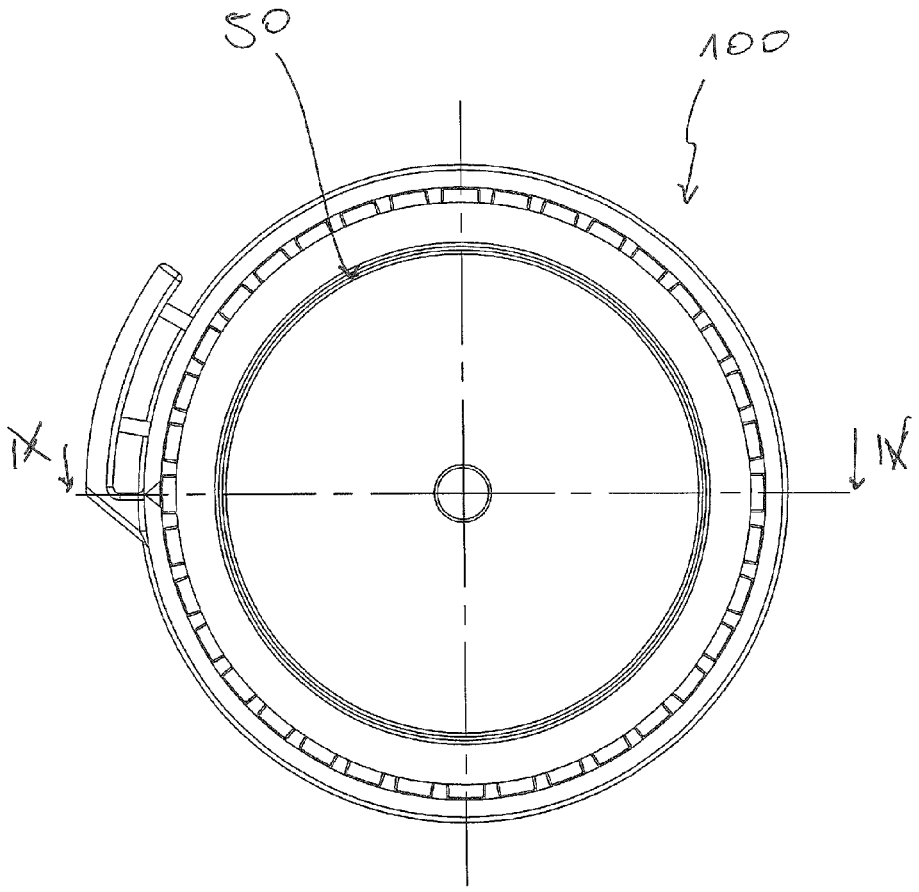
FIG. 8 shows a top view of the closure of FIG. 1.
Figure 9:
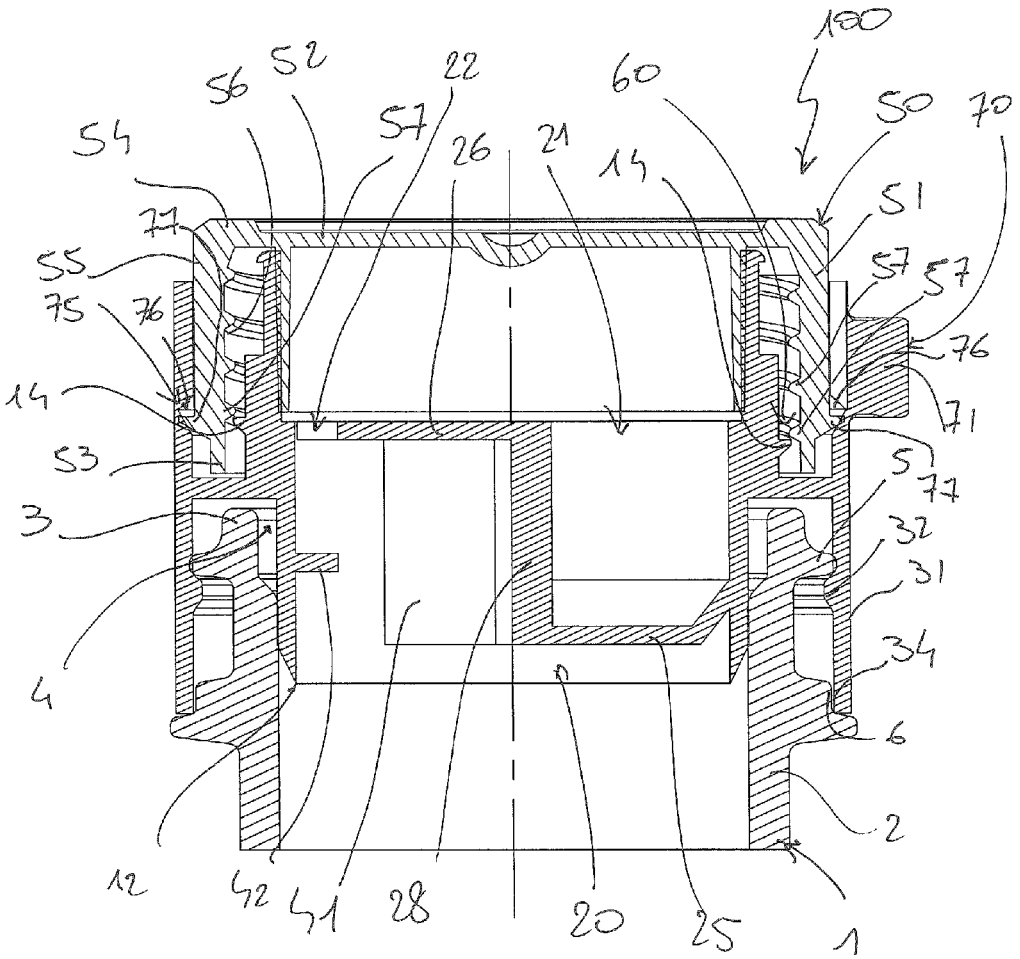
FIG. 9 is a sectional view taken along the line V-V of FIG. 8.

Although this is not expressly shown, the individual features described with reference to each embodiment shall be intended as auxiliary and/or interchangeable with other features, as described with reference to other embodiments.

Referring to the annexed figures, numeral 10 generally designates a pourer according to an embodiment of the present invention.

The pourer 10 is designed to be fitted to a container 1, such as an oil bottle.

In the example of the figures, the container 1 is a bottle and comprises a neck 2 that terminates in a mouth 3 defining an orifice 4.

Thus, the pourer 10 is designed to be fitted to the mouth 3 of the container 1.

While the pourer 10 in itself may be oriented in any direction, for the purposes of the present direction the vertical axis will be defined as the longitudinal axis X-X of the pourer 10 and conventionally the bottom side will be the side of the pourer 10 designed to face the container 1, and the top side will be the one designed to face the consumer; this is actually the normal orientation of the pourer 10 when fitted to a normally oriented bottle.

Likewise, conventionally, the liquid flowing out of the pourer 10 will be directed from the side designed to face the container 1 to the side designed to face the consumer.

The pourer 10 comprises a pouring body 11, in this example a tubular member, which extends in a longitudinal direction X-X between a first end 12 and a second end 13.

The first end 12 is located below the second end 13 in the longitudinal direction X-X.

The second end 13 delimits the mouth 16 of the pourer 10 and has an annular lip 15 for easier pouring of the liquid in the container 1.

In other words, the first end 12 is placed upstream from the second end 13, in the longitudinal direction X-X relative to the liquid outflow direction, designated by the arrow F.

For the mouth 3 of the container 1 to be fitted with the pourer 10, the pourer 10 comprises fixing members 30 adapted to prevent any longitudinally and optionally rotational movement of the pourer 10 relative to the container 1.

In the example of the figures, the fixing members 30 include first fixing members for preventing longitudinal displacements of the pourer 10 relative to the container 1 and second fixing members for preventing angular displacements of the pourer 10 relative to the container 1.

The first fixing members include a sleeve 31 disposed outside the tubular member 11 and fastened thereto, here via a flange 33 that transversely projects out of the sleeve 31. An annular ridge 32 is formed on the inner surface of the sleeve 31, for snap engagement of a collar 5 formed on the neck 2 of the container 1 and the second fixing members include axial ribs 34 arranged on the interior of the sleeve 31 and designed to engage corresponding grooves 6 on the neck 3 of the container 1.

The pourer 10 may also be of the in-bore type and/or only have fixing members for preventing longitudinal displacements of the pourer 10 relative to the container 1.

The pourer 10 comprises members for liquid interception 20 arranged in the pouring body 11 to define a first pouring orifice 21 and a second pouring orifice 22.

According to a first embodiment, the first 21 and second 22 pouring orifices lie on respective planes perpendicular to the longitudinal direction X-X or have respective axes A-A, B-B extending parallel to the longitudinal direction X-X.

The first 21 and second 22 pouring orifices define first 23 and second 24 pouring areas respectively, with the first pouring area 23 being larger than the second pouring area 24.

The members for liquid interception 20 include a first wall 25 and a second wall 26 arranged in offset positions in the longitudinal direction X-X and projecting into the pouring body 11 from the inner surface 11*a* of the pouring body 11.

Due to the presence of two walls offset in the longitudinal direction X-X, the lower wall acts somewhat as a "breakwater" for the second wall, thereby slowing down the liquid that flows from the container to the upper portion of the pourer and prevent the first part of liquid flowing from the container from forming an uncontrolled jet, during pouring, and from flowing toward areas external to the container, where the user does not want the pour the product.

It will be understood that the action of slowing down the flow of fluid by the two offset walls is also effected in the opposite direction, i.e. from the outside to the inside of the container. Therefore, the two walls also act as an obstacle or a deterrent for a counterfeiter who would attempt to fraudulently refill the container with a viscous liquid after use.

According to an embodiment, the projections of the two walls 25, 26 on a plane perpendicular to the longitudinal direction X-X partially overlap. In other words, the two walls 25, 26 are staggered in the longitudinal direction X-X.

In this example, the first wall 25 is located below the second wall 26 and the second wall 26 is configured to form the first pouring orifice 21 and the second pouring orifice 22.

Advantageously, the axes A-A and B-B of the first 21 and second 22 pouring orifices extend perpendicular to the planes defined by the first 25 and second 26 walls.

According to one embodiment, the second wall 26 is placed at substantially half the length of the pouring body 11 and the first wall 25 is placed in the proximity of the lower end 12 of the pouring body 11.

Particularly, the second wall 26 extends inside the pouring body 11 up to one edge 26*a* thereof which forms, with the inner surface 11*a* of the pouring body 11, the first pouring orifice 21, whereas the second pouring orifice 22 is defined by a hole formed in the second wall 26.

According to one embodiment, the second pouring orifice 22 is formed in a portion of the second wall 26 located near the inner surface 11*a* of the pouring body 11.

In this example, the second wall 26 is shaped as a half-circle with the semicircular portion 26*b* joined to the inner surface 11*a* of the pouring body 11 and the diametrical portion 26*a* defining the above mentioned edge.

The first wall 25 also extends inside the pouring body 11 up to one edge 25*a* thereof which forms with the inner surface 11*a* of the pouring body 11 a passageway 27 for the flow of liquid from the container 1 to the upper wall 26.

In this example, the first wall 25 is shaped as a half-circle with the semicircular portion 25*b* joined to the inner surface 11*a* of the pouring body 11 and the diametrical portion 25*a* defining the above mentioned edge.

According to one embodiment, the pourer 10 comprises a stem 28 extending in the longitudinal direction X-X, which is interposed between the two walls 25 and 26. Particularly, the stem 28 has a first end 28*a* connected to the first wall 25 and a second end 28*b* connected to the second wall 26. More particularly, the ends 28*a*, 28*b* of the stem 28 are connected to the median portions of the respective diametrical portions 25*a*, 26*b* of the two walls 25, 26. Therefore, the stem 28 acts not only as a connection between the two walls 25 and 26 but also as a stiffener for the walls 25 and 26 that project out of the inner surface 11*a* of the pouring body 11.

The members for fluid interception 20 also include two wings 40, 41 for intercepting the liquid that flows from the passageway 27 toward the first pouring office 21. In this example, the two wings 40, 41 extend in the longitudinal direction X-X between respective lower 40*b*, 41*b* and upper 40*a*, 41*a* ends and project out of the stem 28 in a direction away from the first wall 25 such that they are located below the second wall 26. Particularly the upper ends 40*a*, 41*a* of the wings 40, 41 are connected under the second wall 26.

According to an embodiment, the members for liquid interception 20 further comprise a tab 42 for intercepting the liquid flowing toward the second pouring orifice 22. Namely, the tab 42 is located below the second wall 26 in substantially aligned relationship to the second pouring orifice 22, in the longitudinal direction X-X.

The pourer 10 is adapted to be fitted with a cap 50, whose function, when fitted to the pourer, is to prevent liquid from flowing out of the container 1.

The cap 50 and the pourer 10 form a closure 100 adapted to be fitted to the mouth 2 of the container 1.

According to an embodiment, the cap 50 comprises a tubular member 51 open at its bottom and closed at its top by a transverse wall 52. Particularly, the tubular member 51 extends in a longitudinal direction X-X between a lower end 53, at which it is open, and an upper end 54, having the transverse wall 52 thereat.

The cap 50 has an outer surface 55 and an inner surface 56, consisting of the outer and inner surfaces of the tubular member 51 respectively. The outer surface 55 corresponds to the part of the cap 50 that can be grasped by a user for normal opening and closing operations.

The closure 100 comprises attachment members 60 for reversibly attaching the cap 50 to the pourer 10 for normal opening and closing operations.

In the embodiment of the figures, the attachment members include threads 57 formed on the inner surface 55 of the cap 50 and adapted to be engaged with threads 14 associated with the pourer 10, e.g. formed on the outer surface of the pouring body 11.

The closure 100 may further include tamper-evident members 70 for providing evidence of first opening of the closure 100.

The tamper-evident members 70 include a tear-off seal 71.

The closure 100 is adapted to be irreversibly turned from a first configuration, before tear off of the seal 71 to a second configuration, after tear off of the seal 71.

Particularly, the seal 71 is configured to prevent removal of the cap 50 from the pourer 10 when the closure 100 is in the first configuration and allow removal of the cap 50 from the pourer 10 when it is torn off, i.e. only when the closure 100 is in the second configuration.

The tear-off seal 71 comprises a tear-off tab attached to the pourer 10 through a breakable portion 72 and has a pull portion 73 which is adapted to be pulled to tear off the tear-off tab 71.

In the example of the figures, the tear-off tab 71 is attached to the sleeve 31.

Attachment members 75 are provided to attach the cap 50 to the tear-off tab 71. These attachment members 75 include an annular ridge 77 formed on the outer surface 55 of the cap 50 and designed for engagement in an annular trough 76 formed in the inner surface of the tear-off tab 71.

During first opening, the user tears off the tear-off tab 71, to disengage the annular ridge 77 from the annular trough 76, thereby allowing the cap 50 to be unscrewed from the pouring body 10 and removed from the pourer 10.

According to the desired flow rate of liquid, the user may rotate the container 1 or, in certain embodiments, the pourer 10, and incline the container 1 to downwardly orient one of the two pouring orifices 21, 22 and pour the liquid with the flow rate associated with the selected pouring orifice.

It will be appreciated that the pourer of the present invention fulfills the intended purposes.

Those skilled in the art will obviously appreciate that a number of changes and variants may be made to the arrangements as described hereinbefore to meet incidental and specific needs.

For example, unless otherwise imposed by evident technical limitations, any feature described in a preferred embodiment may be clearly used in another embodiment, with appropriate adaptations.

Likewise, the continuity of the pourer components may be broken in any manner, provided that no functional alteration to the relevant component is caused thereby.

Also, slight tapers may be imparted to the portions described above as having an annular, cylindrical shape, in response to technological requirements.

All the changes will fall within the scope of the invention, as defined in the following claims.

What is claimed is:

1. A pourer for a container having a neck and a mouth, said pourer comprising:

a pouring body extending in a longitudinal direction between a first end and a second end, said first end being located below said second end in said longitudinal direction, members for liquid interception arranged in said pouring body to define a first pouring orifice and a second pouring orifice, wherein:

said first and second pouring orifices have first and second pouring areas respectively, said first pouring area is greater than said second pouring area, said members for liquid interception include a first wall and a second wall arranged in offset positions in said longitudinal direction and projecting into said pouring body from an inner surface of the pouring body, wherein said members for liquid interception include two wings for intercepting the outflow of liquid toward said first pouring orifice said first wall is located below said second wall in said longitudinal direction, said second wall has an edge, said second wall extends inside said pouring body from a first portion of the inner surface to said edge, said edge forms with a second portion of the inner surface of said pouring body said first pouring orifice, said second pouring orifice is defined by a hole formed in said second wall.

2. A pourer as claimed in claim 1, wherein the first and second walls are arranged in misaligned positions in the longitudinal direction.

3. A pourer as claimed in claim 1, wherein said second wall is shaped as a half-circle, said half-circle comprising a semicircular portion and a diametrical portion, said semicircular portion being joined to said first portion of the inner surface of the pouring body, said diametrical portion defining said edge of the second wall.

4. A pourer as claimed in claim 1, wherein:

said first wall extends inside said pouring body to an edge, said edge of the first wall forms with the inner surface of the pouring body a passageway for the flow of liquid from the container to said second wall.

5. A pourer as claimed in claim 1, wherein said second pouring orifice is formed in a portion of the second wall located near the inner surface of the pouring body.

6. A pourer as claimed in claim 1, wherein said members for liquid interception include a stem extending in the longitudinal direction between the first and the second walls and having a first end connected to the first wall and a second end connected to the second wall.

7. A pourer as claimed in claim 1, wherein said members for liquid interception include a tab for intercepting the flow of liquid toward the second pouring orifice, said tab being located below the second wall in substantially aligned relation to the second pouring orifice, in the longitudinal direction.

8. A pourer as claimed in claim 1, wherein the first and second walls are arranged in misaligned positions in the longitudinal direction.

* * * * *